US010741128B2

(12) United States Patent
Zhang et al.

(10) Patent No.: US 10,741,128 B2
(45) Date of Patent: Aug. 11, 2020

(54) DUAL SCAN OUT DISPLAY SYSTEM

(71) Applicant: Intel Corporation, Santa Clara, CA (US)

(72) Inventors: Yanli Zhang, San Jose, CA (US); Srikanth Kambhatla, Portland, OR (US)

(73) Assignee: INTEL CORPORATION, Santa Clara, CA (US)

( * ) Notice: Subject to any disclaimer, the term of this patent is extended or adjusted under 35 U.S.C. 154(b) by 26 days.

(21) Appl. No.: 15/472,012

(22) Filed: Mar. 28, 2017

(65) Prior Publication Data

US 2018/0286315 A1 Oct. 4, 2018

(51) Int. Cl.
*G09G 3/3266* (2016.01)
*G09G 3/3275* (2016.01)
*G09G 3/36* (2006.01)

(52) U.S. Cl.
CPC ..... *G09G 3/3266* (2013.01); *G09G 3/3275* (2013.01); *G09G 3/3674* (2013.01); *G09G 3/3685* (2013.01); *G09G 2310/0205* (2013.01); *G09G 2310/0291* (2013.01); *G09G 2310/08* (2013.01); *G09G 2320/0252* (2013.01); *G09G 2360/18* (2013.01)

(58) Field of Classification Search
None
See application file for complete search history.

(56) References Cited

U.S. PATENT DOCUMENTS 6,229,516 B1 * 5/2001 Kim ..... G09G 3/3666 345/100
2007/0152951 A1 * 7/2007 Ahn ..... G09G 3/342 345/102
2016/0063961 A1 * 3/2016 Pyo ..... G09G 3/2022 345/213
2016/0379559 A1 * 12/2016 Yamaji ..... G09G 3/2096 345/213
2017/0330503 A1 * 11/2017 Yang ..... G09G 3/2092
2017/0365461 A1 * 12/2017 Iwaki ..... H01L 21/0271
2018/0054611 A1 * 2/2018 Shin ..... H04N 13/359
2018/0070095 A1 * 3/2018 Chou ..... H04N 19/426

* cited by examiner

*Primary Examiner* — Matthew Yeung
(74) *Attorney, Agent, or Firm* — Womble Bond Dickinson (US) LLP

(57) ABSTRACT

A dual scan out display system and method for performing the same are described. In one embodiment, the computing system comprises a display and a controller to provide data for separate portions of the display simultaneously using dual scanout.

23 Claims, 7 Drawing Sheets

DUAL SCAN OUT DISPLAY SYSTEM

FIELD OF THE INVENTION

Embodiments disclosed herein relate to the field of computing systems; more particularly, embodiments disclosed herein relate to providing data to a display via dual (or multiple) scan out.

BACKGROUND OF THE INVENTION

VR (Virtual Reality) system can be divided into three segments depending on where the computing power resides. On the low end, a VR system consists of a phone-based VR system, where the computing power is in the phone. On the high end, a VR system is a tethered VR system, where the computing power is mainly outside of the Head Mounted Device (HMD). In the middle, a VR system is All-in-one VR system, where the computing power is within the HMD.

From imaging perspective, a VR system generates a magnified virtual image through imaging optics and either one or two discrete near to eye displays.

Displays for such VR and other computing systems often include panel driving logic. The panel driving logic generally involves display timing controller (TCOM) and row (gate) and column (source) drivers. The TCON receives pixel data from the source such as, for example, a System-on-Chip (SoC), and then controls row and column drivers. The rows are commonly turned on one by one from top to bottom while the data for each row is sent by the source driver. In mobile displays, the functions of source driver and the TCON are often combined and such architecture is referred to as a TCON Embedded Driver (TED).

Motion to photon (M2P) latency is the length of time between the user movement input to full display pixel update to reflect the associated change. Studies have shown low motion-to-photon (<20 ms) latency is necessary to convince an individual's mind that they are in the simulated virtual world (Presence). High motion-to-photon latency can cause motion sickness and nausea. The whole process chain from sensor input to graphics rendering to display contribute to the M2P latency. Current approach of reducing display latency is through higher (90 Hz or higher) than traditional refresh rate (60 Hz). Higher display refresh rate requires higher pixel clock support from both the component providing the display data and the display panel.

For phone-based VR systems, the VR display is the phone display—and hence it is a one-display option. Today such phone displays only have one source driver or TED and it is often placed at the short edge in order to have thin borders at the two long edges. In this case, the left and right eye images are not synchronized since the rows are scanned from left to right direction. Studies have shown this update delay between left and right eye causes discomfort.

All-in-one VR and tethered VR systems often use two discrete displays. In such system, further reduction of the display scanning time is desired since it helps reduce display latency for Organic Light Emitting Display (OLED)-based VR panel solution. Liquid Crystal Display (LCD)-based panels are also considered for VR application, but LCDs have the challenge on slow response time to meet the requirement on low persistence and low latency.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

In the following description, numerous details are set forth to provide a more thorough explanation of the present invention. It will be apparent, however, to one skilled in the art, that the present invention may be practiced without these specific details. In other instances, well-known structures and devices are shown in block diagram form, rather than in detail, in order to avoid obscuring the present invention.

A computing system or device is disclosed that includes a display (e.g., a panel) and a controller to provide data for separate portions of the display simultaneously. In one embodiment, the computing system and/or display is part of a virtual reality (VR) system, augmented reality (AR) system, mobile phone, portable computer system, etc.

In one embodiment, the separate portions of the display are left and right halves. In such a case, techniques disclosed herein scan the left and right halves of the image simultaneously by using two sets of column and row drivers (or gate and source drivers). In one embodiment, each set of drivers is driven by a separate pipe in the case of multiple pipes. In one embodiment, each set of drivers is driven by a separate port in the case of one pipe. The data for the pipes and/or ports is provided by a display controller in a processing device (e.g., System-on-Chip (SoC), processor, microcontroller, etc.). By using two or more pipes to provide the data to a display, the latency associated with displaying the data is reduced.

Figure 1:
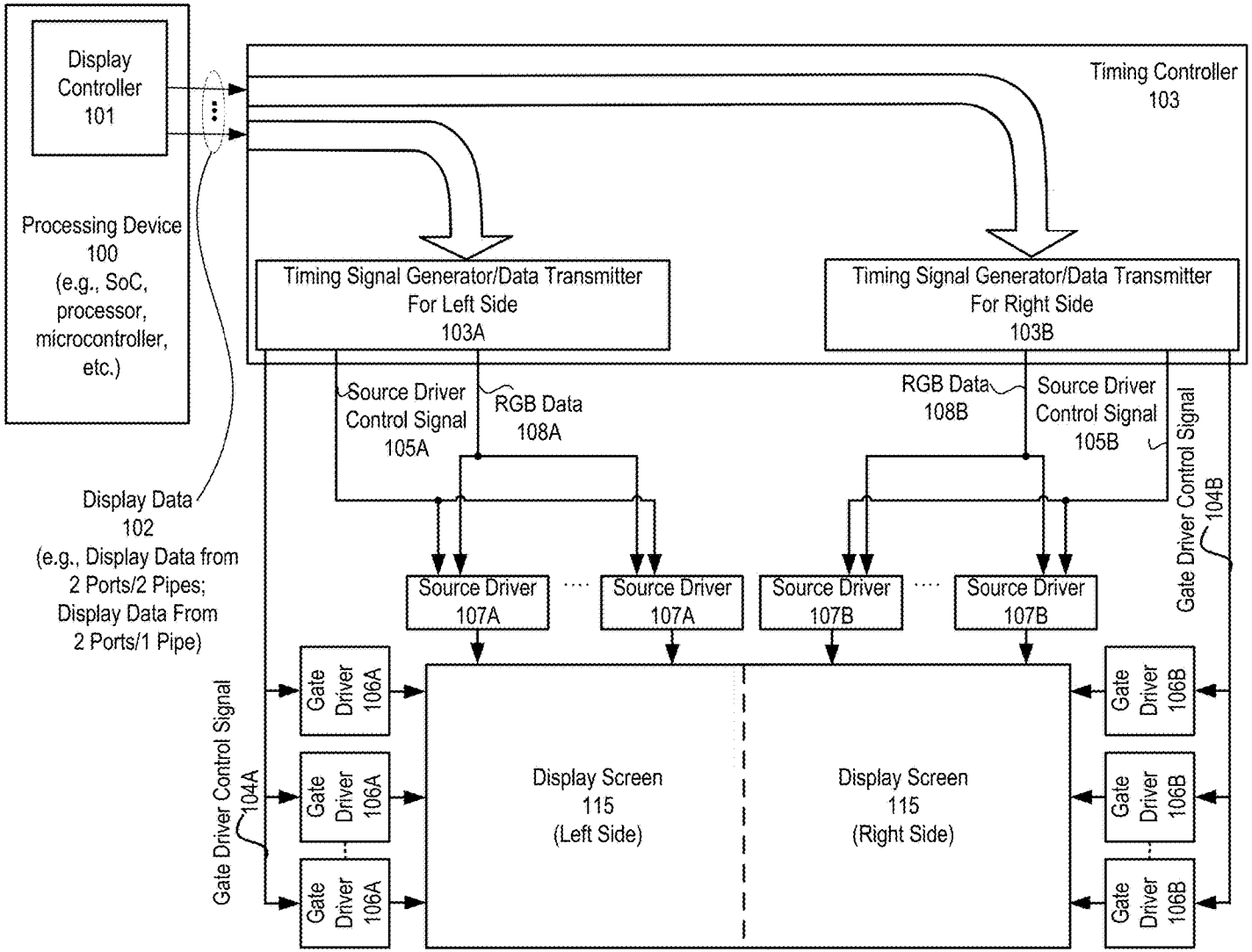
FIG. 1 is a block diagram of one embodiment of a computing system.

FIG. 1 is a block diagram of one embodiment of a computing system. Referring to FIG. 1, a processing device (e.g., SoC, processor, microcontroller, etc.) 100 includes a display controller 101 that provides sets of display data 102 for a display. Display data 102 includes data that is to be displayed on display screen 115 that is part of a display panel. Display data 102 may also include timing information and/or signals for use in displaying the data on display screen 115 correctly. In one embodiment, display data 102 comprises display data from two ports that are feed by two data pipes. In another embodiment, display data 102 comprises display data from two ports that are feed by a single data pipe.

In one embodiment, processing device 100 provides display data 102 to a timing controller 103. Timing controller 103 provides control and data signals for displaying data on display screen 115. In one embodiment, a plurality of sets of drivers are responsive to data and control signals from timing controller 103 to cause the display data from processing device 100 to be displayed on display screen 115. In one embodiment, the sets of drivers comprise are row drivers and column drivers, which are commonly referred to gate drivers and source drivers, respectively.

In one embodiment, each gate driver turns on a switching element that is connected to each sub-pixel electrode of the display panel by a unit of one horizontal line, and each source driver supplies a potential corresponding to display data to pixels of the horizontal line selected by the gate driver.

In one embodiment, there are two sets of gate drivers, 106A and 106B, and two sets of source drivers 107A and 107B. While two sets of drivers are shown, the techniques described herein are not limited to two sets of drivers. In one embodiment, the set of gate drivers 106A and source drivers 107A and the set of gate drivers 106B and source drivers 107B are used to displays data on a separate portion of the display. In one embodiment, the separate portions of the display are halves, and two sets of gate and source drivers display data on separate halves of the display. That is, gate drivers 106A and source drivers 107A are used to display data on the left side of display screen 115, while gate drivers 106B and source drivers 107B are used to display data on the right side of display screen 115. In another embodiment, the separate portions of the display are quarters, and four sets of gate and source drivers display data on separate quarters of the display.

The data to be displayed by the set of gate drivers 106A and source drivers 107A and the data to be displayed by the set of gate drivers 106B and source drivers 107B, along with their control signals are provided by timing controller 103. Timing controller 103 includes timing signal generator and data transmitter 103A and timing signal generator and data transmitter 103B to provide the data and control signals to the set of gate drivers 106A and source drivers 107A and the set of gate drivers 106B and source drivers 107B, respectively. Timing controller 103 receives display data 102 from one port of processing device 100 and provides it to timing signal generator and data transmitter 103A, while the data from another port of processing device 100 is provided to timing signal generator and data transmitter 103B. Thus, regardless of whether processing device 100 uses one data pipe or two data pipes, the data from the separate ports is provided to a different timing signal generator and data transmitter. In response to display data 102 from processing device, timing signal generator and data transmitter 103A provides RGB data 108A and source driver signal 105A to source drivers 107A and provides gate driver control signal 104A to gate drivers 106A. In response to display data 102 from processing device, timing signal generator and data transmitter 103B provides RGB data 108B and source driver signal 105B to source drivers 107B and provides gate driver control signal 104B to gate drivers 106B. Using the control signals, the sets of gate and source drivers display the data on display screen 115 in a manner well-known in the art.

In alternative embodiments, the number of sets of drivers are based on the number of portions of display screen 115 that are going to be driven with display data simultaneously. For example, if 3, 4, 5, etc. portions of display screen 115 are going to be driven with data simultaneously, then there are 3, 4, 5, etc. sets of drivers, respectively.

Note that in one embodiment, gate drivers 106A and 106B are embedded in the display panel. In such a case, these may be called gate on array (GOA) or gate in pixel (GIP). In one embodiment, portions of timing controller 103 are embedded in a source driver.

Note that timing controller 103 may include a receiving section that receives the input image data transmitted from processing device 100. The input image data may include, for example, a signal including an image data of R (red), G (green), and B (blue). Other inputs to timing controller 103 may include a display control signal (a vertical synchronization signal Vsync, a horizontal synchronization signal Hsync, and a writing control signal Enable. In the case where the images have a frame structure, the timing controller drives the display panel so that the display panel is scanned by one horizontal line.

Figure 2A:
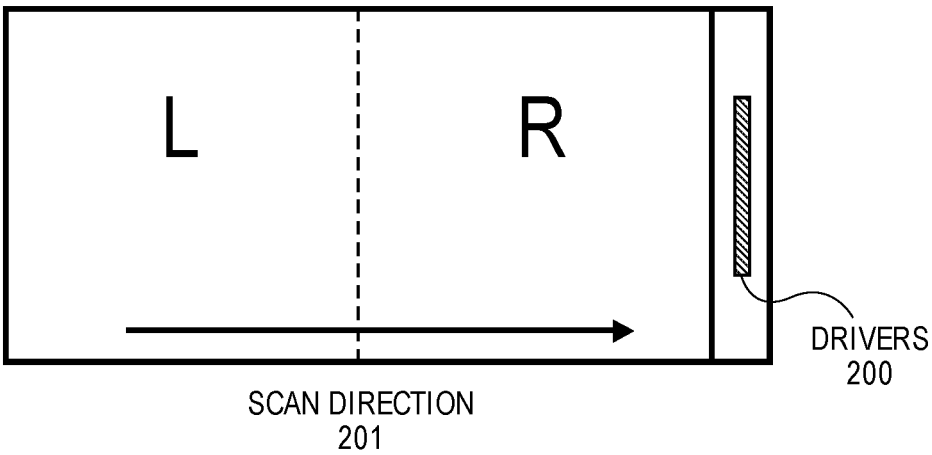
FIG. 2A illustrates a typical display panel displaying data according to a scan direction.
Figure 2B:
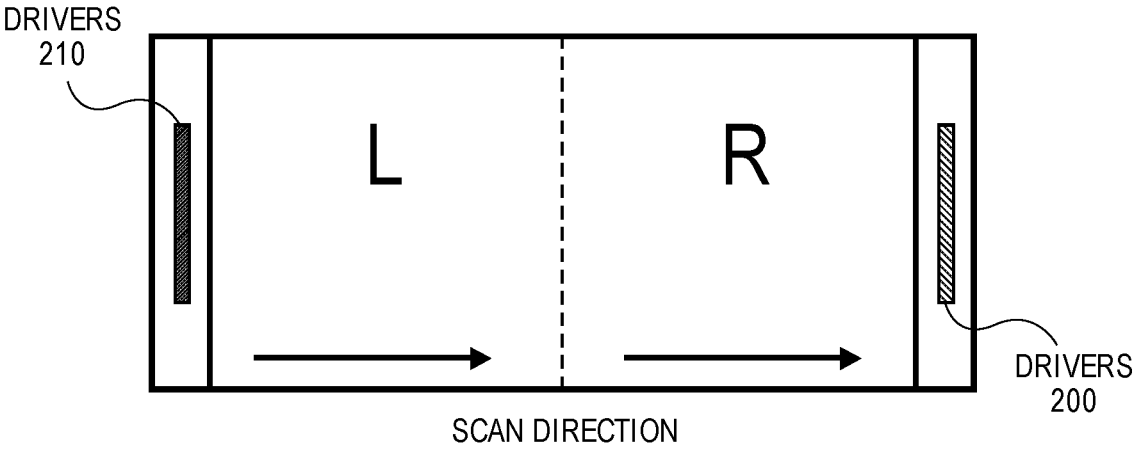
FIG. 2B illustrates a display panel having two sets of drivers.

FIG. 2A illustrates a typical display panel displaying data according to a scan direction. For typical display panels, the thin bezel is an important form factor for mobile displays especially for phones, so the column/source driver is often placed at the top or bottom of the display and GIP (Gate Drive in Panel) has been developed to enable thin bezels in mobile displays. In this case, the display panel only includes one set of drivers 200. For phone-based VR displays, the data is scanned in landscape direction, such as scan direction 201, as shown in FIG. 2A, with each row of display data being scanned out across the entire display panel one at a time. This causes the delay in left and right eye data update and such imbalance or non-synchronization is reported to causes discomfort. In contrast, FIG. 2B illustrates a display panel having two sets of drivers 210 and the display data is scanned out in a one scan direction but with two rows of display data, one for each half of the display panel, being scanned out at a time.

Referring back to FIG. 1, in one embodiment, the data is provided for separate portions of display panel 105 simultaneously using separate data pipes from the controller 101. In such a case, where sets of gate and source drivers cause the data to be displayed on the display, the data for each set of gate and source drivers is provided by a distinct data pipe of the plurality of data pipes. In one embodiment, the data is provided to each of the data pipes from a frame buffer. In one embodiment, the frame buffer is divided between the data pipes. If there are two data pipes, in one embodiment, the frame buffer is divided in half, with the data for each data pipe coming from one of the halves. In one embodiment, separate sets of frame data for each data pipe is fetched from the frame buffer in parallel in an isochronous manner and sent to data pipes that scan out the frame data in parallel to the display.

Figure 3:
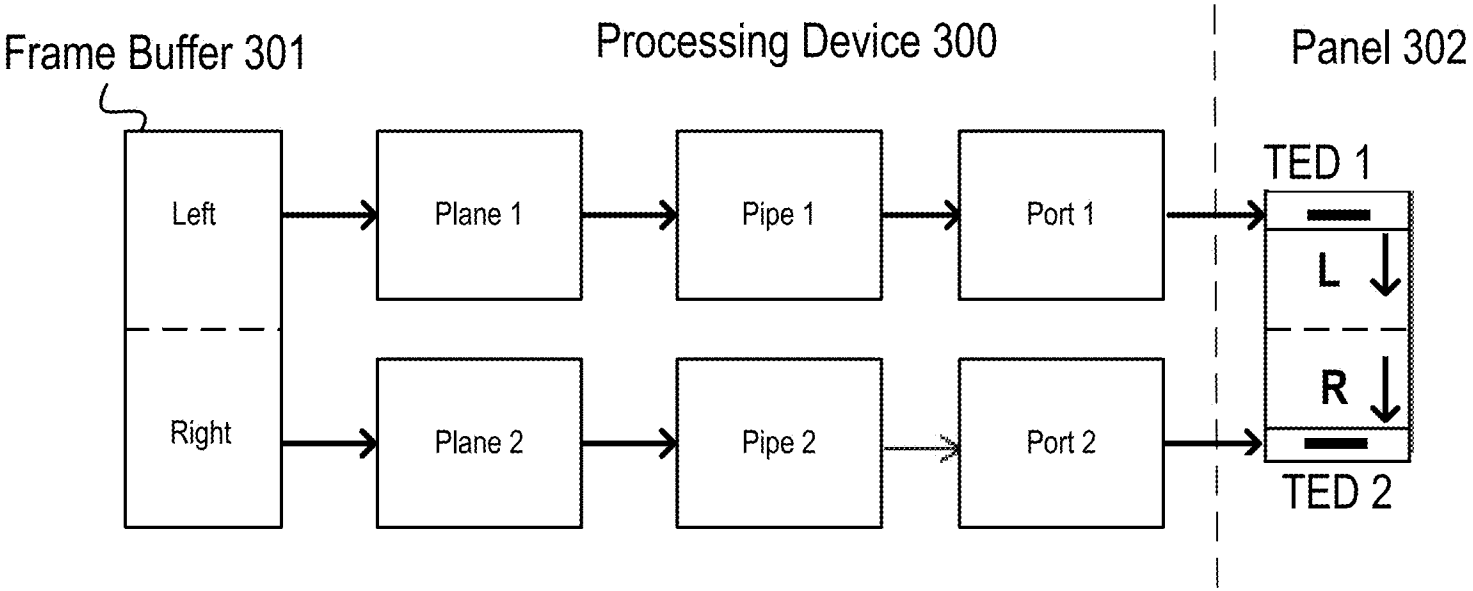
FIG. 3 illustrates an example of two data pipes providing data to a panel.

In one embodiment, there are two data pipes. FIG. 3 illustrates an example of two data pipes providing data to a panel. Referring to FIG. 3, frame buffer 301 of a processing device (e.g., SoC, processor, microcontroller, etc.) has left and right halves. Under control of a display controller in the processing device, a plane of data from each of the halves is fetched and provided to a separate pipe. For example, plane 1 is fetched from the left half of frame buffer 301 and provided to pipe 1, while plane 2 is fetched in parallel from the right half of frame buffer 301 and provided to pipe 2. The data of planes 1 and 2 are provided by pipes 1 and 2 to display panel 302 via ports 1 and 2, respectively. Display panel 301 includes two sets of drivers to drive separate portions of the display screen of display panel 302. In one embodiment, these are part of TCON Embedded Driver 1 (TED 1) and TED 2. The sets of drivers of TED 1 and 2 update two rows of data, one for each portion of the display screen, simultaneously.

The dual scan architecture of FIG. 3 may be used for a phone-based VR system and has a combination of features that operate together to provide a solution to problems set forth above. In one embodiment, the combination has all of the following features:

1. A frame buffer that is split between two (or more) display pipes;
2. Two display pipes to scan out data at the original pixel clock rate. Two row and column drives that can update two rows of data simultaneously;
3. Scan out from the two display pipes in a time-synchronized manner (one of the pipes being the timing-master).
4. Since two rows are updated simultaneously, the whole display can be updated faster than the traditional single scan case. Depending on the Vblank setting, there can be two additional benefits besides solving the non-synchronization issue of left and right eye update. If longer Vblank time is used, then it helps liquid crystal (LC)-based displays to be fully switched before the backlight is turned on. If normal Vblank time is used, then it helps increase the display update rate thus reducing the overall motion to photon latency.

In one embodiment, the two display pipes can keep the display refresh rate and normal Vblank time that are used for displaying the data using one display pipe by scanning out data at each port at a reduced pixel clock (in comparison to the original pixel clock used for the single display port) since the time it takes to do full display update is reduced due to dual scan. The benefit of this embodiment is relaxed pixel clock requirement on panel side.

In another embodiment, if the two display pipes to scan out data at the original pixel clock, then a higher resolution display can be supported with original Vblank time and display refresh rate comparing to single scan case at the same pixel clock.

In one embodiment, the dual scan architecture of FIG. 3 also uses accelerated timing for data scanout from the processing device (e.g., processing device 100 of FIG. 1). Use of accelerated timing for scanout reduces the time to transmit the content to about half. This increase the pixel clock required. More specifically, the display controller of the processing device determines the timing of that the display data is sent to the timing controller, which thereafter causes the display data to be displayed on the display screen. By using the two ports to scan out data from the display controller at the same time, to meet the requirements of the refresh rate when displaying a row of display data on each half of the display screen simultaneously, the pixel clock that is calculated by the display controller need only be one-half the normal rate since both halves of a row are displayed on the display screen at the same time. However, by using the two display ports from the display controller of the processing device to scan out data at the same time in cooperation with accelerated timing, the display controller can be configured to calculate a pixel clock that is at a higher rate to push the data to the timing controller sooner, thereby using a higher refresh rate. In one embodiment, the pixel clock calculated by the display controller stays at about the same as a pixel clock would be for the traditional single pipe scan out and the pixels are displayed in half the time.

Figure 4:
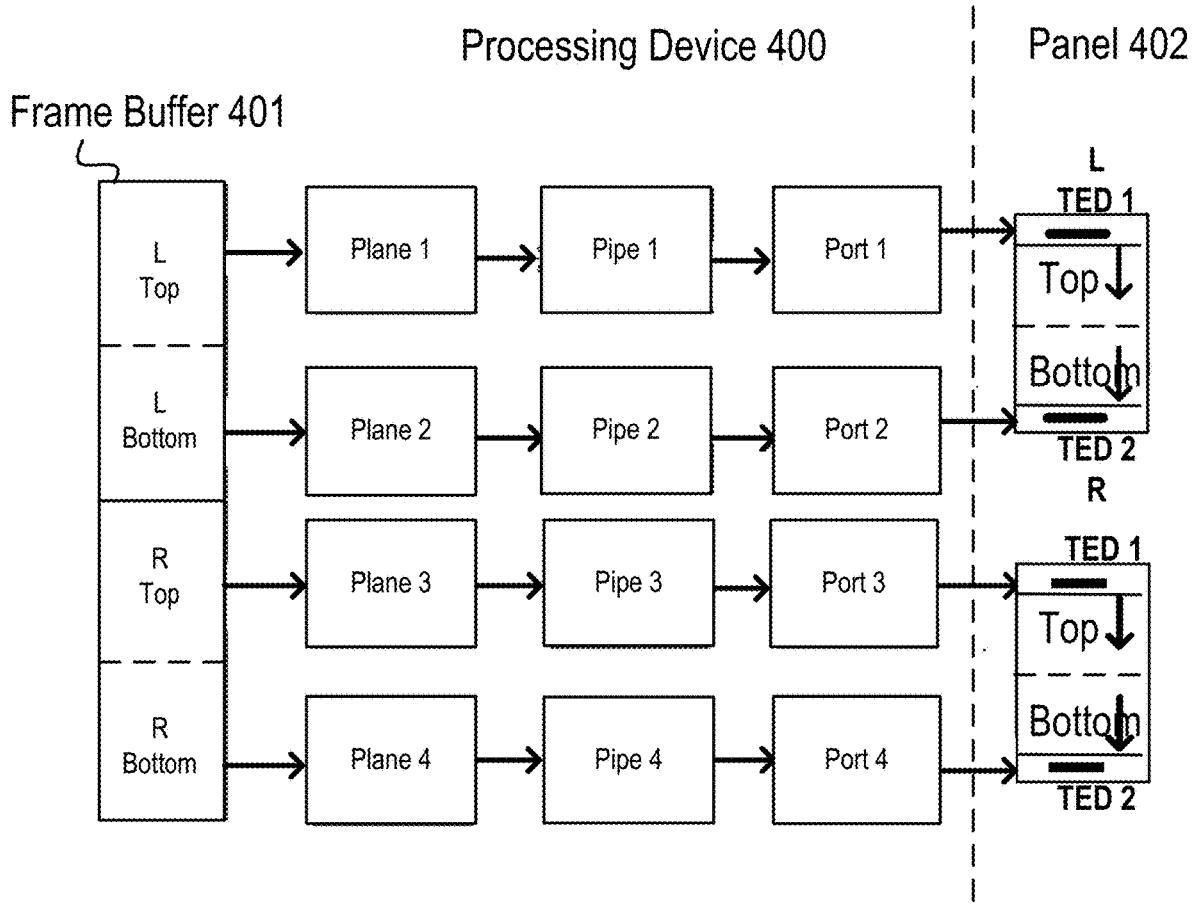
FIG. 4 illustrates an example of four data pipes providing data to a panel.

In another embodiment, there are four data pipes. This dual scan architecture may be used for a two discrete display-based VR system. FIG. 4 illustrates an example of four data pipes providing data to a panel. Referring to FIG. 4, frame buffer 401 of a processing device (e.g., SoC, processor, microcontroller, etc.) has left top and bottom and right top and bottom. Under control of a display controller in the processing device, a plane of data from each of these four is fetched and provided to a separate pipe. For example, plane 1 is fetched from the left top of frame buffer 401 and provided to pipe 1, plane 2 is fetched in parallel from the left bottom of frame buffer 401 and provided to pipe 2, plane 3 is fetched from the right top of frame buffer 401 and provided to pipe 3, and plane 4 is fetched in parallel from the right bottom of frame buffer 401 and provided to pipe 4. The data of planes 1-4 are provided by pipes 1-4, respectively, to display panel 402 via ports 1-4, respectively. Display panel 401 includes two separate display screens that each have two sets of drivers to drive separate portions of the display screen of display panel 402. In one embodiment, each display screen in display panel 402 includes TCON Embedded Driver 1 (TED 1) and TED 2 to drive the data from two of the pipes onto its respective portion of its associated display screen.

Note that there may be any number of data pipes that provide data for the display in parallel and simultaneously.

Figure 5:
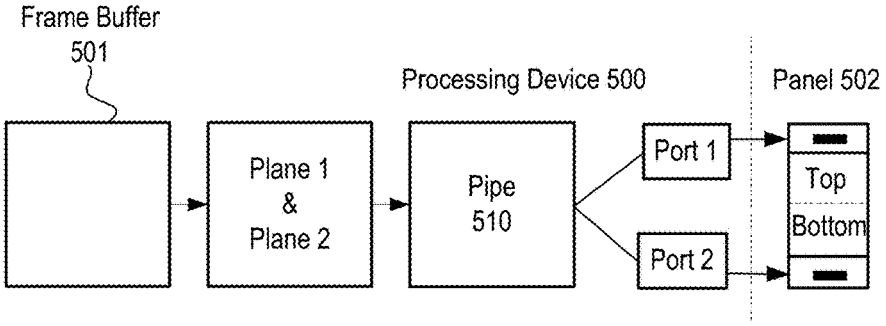
FIG. 5 illustrates an example of such a dual scan architecture.

In another embodiment, the plurality of sets of panel drivers (e.g., column/row drivers, gate/source drivers, etc.) are driven by a single pipe from a display controller of a processing device. In this case, the single pipe has multiple ports, with each of the ports providing data for a distinct one of the plurality of sets of drivers. FIG. 5 illustrates an example of such a dual scan architecture. Referring to FIG. 5, frame buffer 501 provides two planes of data, plane 1 and 2, through a single pipe 510 to panel 502 via ports 1 and 2.

Techniques disclosed herein solve the non-synchronization issue of left and right eye image on a phone-based VR system, help reduce M2P latency for OLED-based two OLED panel VR system (or any panel that has fast response time based VR system), and also help relax the response time requirement for LCD-two panel solution for VR applications.

Figure 6:
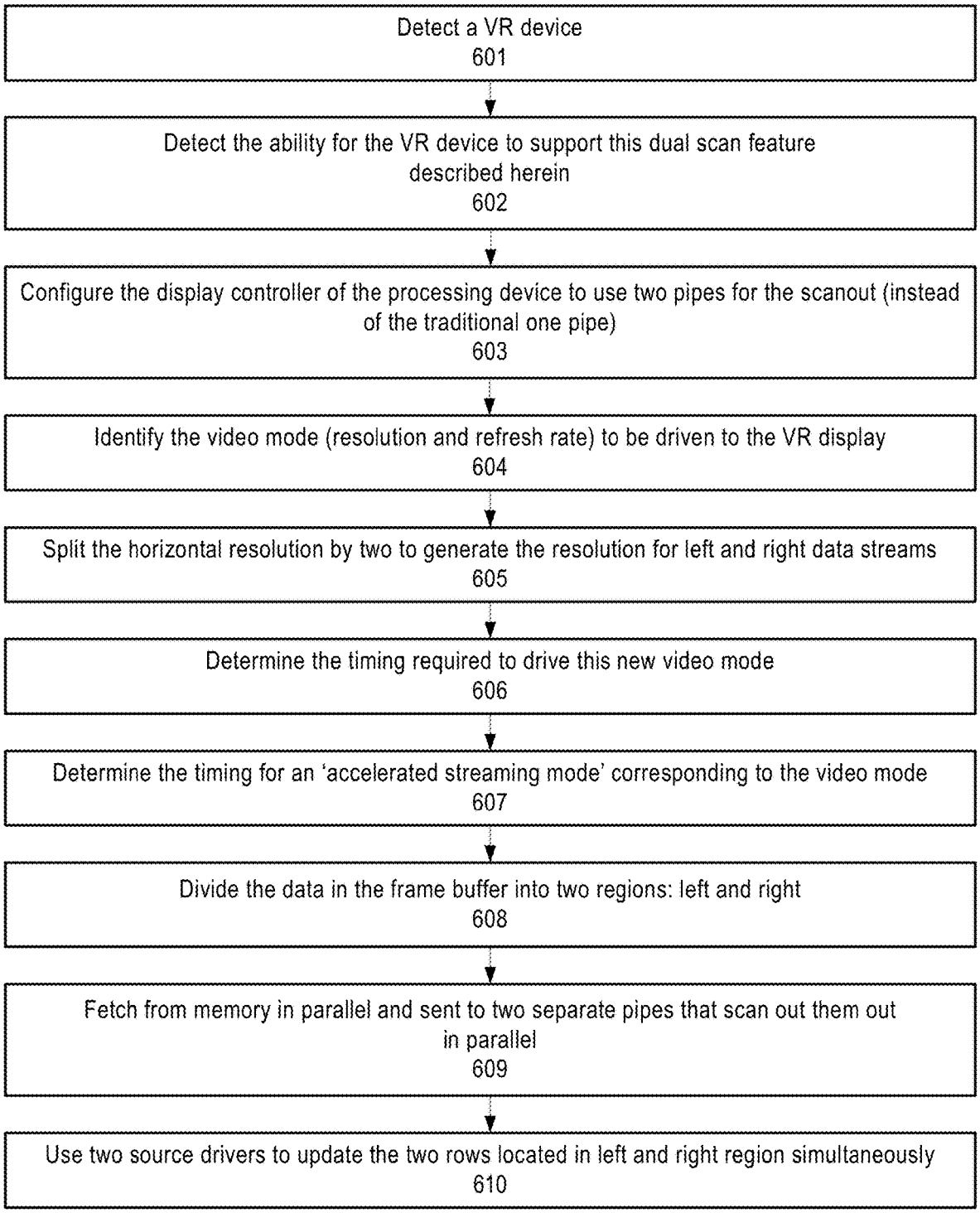
FIG. 6 is a data flow diagram of one embodiment of the dual scan architecture for two pipe operation in a VR-based system.

FIG. 6 is a data flow diagram of one embodiment of the dual scan architecture for two pipe operation in a VR-based system. In one embodiment, the process is performed by processing logic that may comprise hardware (e.g., circuitry, dedicated logic, etc.), software (such as is run on a general purpose computer system or a dedicated machine), firmware, or a combination of the three.

Referring to FIG. 6, the process begins by processing logic in the processing device (e.g., SoC, processor, microcontroller, etc.) detecting a VR device (processing block 601), detecting the ability for the VR device to support this dual scan feature described herein (processing block 602), and configuring the display controller of the processing device to use two pipes for the scanout (instead of the traditional one pipe) (processing block 603). In one embodiment, these operations are performed by system software executing and running on the processing device.

In one embodiment, the discovery of the VR device is performed using a sideband channel for the display interface. In another embodiment, the discovery of the VR device is performed through a custom interface.

In one embodiment, detecting the ability for the VR device to support this dual scan feature implies that the VR device supports the per-eye resolution and the accelerated timing in discussed below.

In one embodiment, configuring the display controller of the processing device to use two pipes for the scanout comprises configuring the pipes such that one display pipe is made the timing master for the scanout.

After configuring the display controller, processing logic (e.g., system software) in the processing device identifies the video mode (resolution and refresh rate) to be driven to the VR display (processing block 604). In one embodiment, this identification occurs based on Extended Display Identification Data (EDID) for the display. In another embodiment, this identification occurs based by using some custom interface enabling the equipment manufacturer to communicate details about the video mode and its timing. This is also identifiable based on the display's data sheets. For purposes herein, this resolution is m×n pixels (where m is the number of pixels in a scanline and n is the number of lines) at a refresh rate of rHz.

Afterwards, processing logic (e.g., system software) in the processing device splits the horizontal resolution by two to generate the resolution for left and right data streams (processing block 605). Thus, each eye has a resolution of (m/2)×n. Note that the refresh rate is also retained at rHz.

Processing logic (e.g., system software) in the processing device also determines the timing required to drive this new video mode (processing block 606). In the example, this timing would be (m/2)×n@r. Note that this should be supportable by each of the two VR displays (or two TCONs (Timing CONtroller) in the same display). The timing for this "per-eye" resolution may be discoverable through a custom interface, by using calculations using standard timing equations, or through the data sheets.

Then processing logic (e.g., system software) in the processing device determines the timing for an 'accelerated streaming mode' corresponding to the video mode (processing block 607). In one embodiment, the accelerated timing is discoverable through a custom interface. The accelerated timing may be discovered through the data sheets. In one embodiment, dual scan capable VR displays export timings for the video mode and the accelerated timing to ensure that together the pixel clock stays the same value as the original pixel clock.

Note that in one embodiment the processing device (e.g., SoC, etc.) continues to use the back buffers for rendering and front buffer for scanout, but does not use front buffer rendering.

Processing logic in the processing device divides the data in the frame buffer into two regions: left and right (processing block 608) and the left and right frame data are fetched from memory in parallel and sent to two separate pipes that scanout them out in parallel (processing block 609). In one embodiment, the left and right frame data are fetched from memory in an isochronous manner. In one embodiment, the two pipes are setup for synchronized data transfer by having one pipe to be the timing master to ensure left and right images are updated simultaneously.

Upon receiving the data, processing logic of the panel circuit on the VR display uses two source drivers to update the two rows located in left and right region simultaneously (processing block 610).

In one embodiment, the dual scan architecture described herein can be implemented together with Asynchronous Time Warping (ATW) type of rendering approach which enables faster display frame buffer update to reduce end to end M2P latency. For example, assuming the pixel clock needed to drive a display with m×n resolution at 60 Hz is P, then using two pipes and two TCONs running at the same pixel clock at P will be able to finish the display pixel update in half of 60 Hz frame time.

Figure 7A:
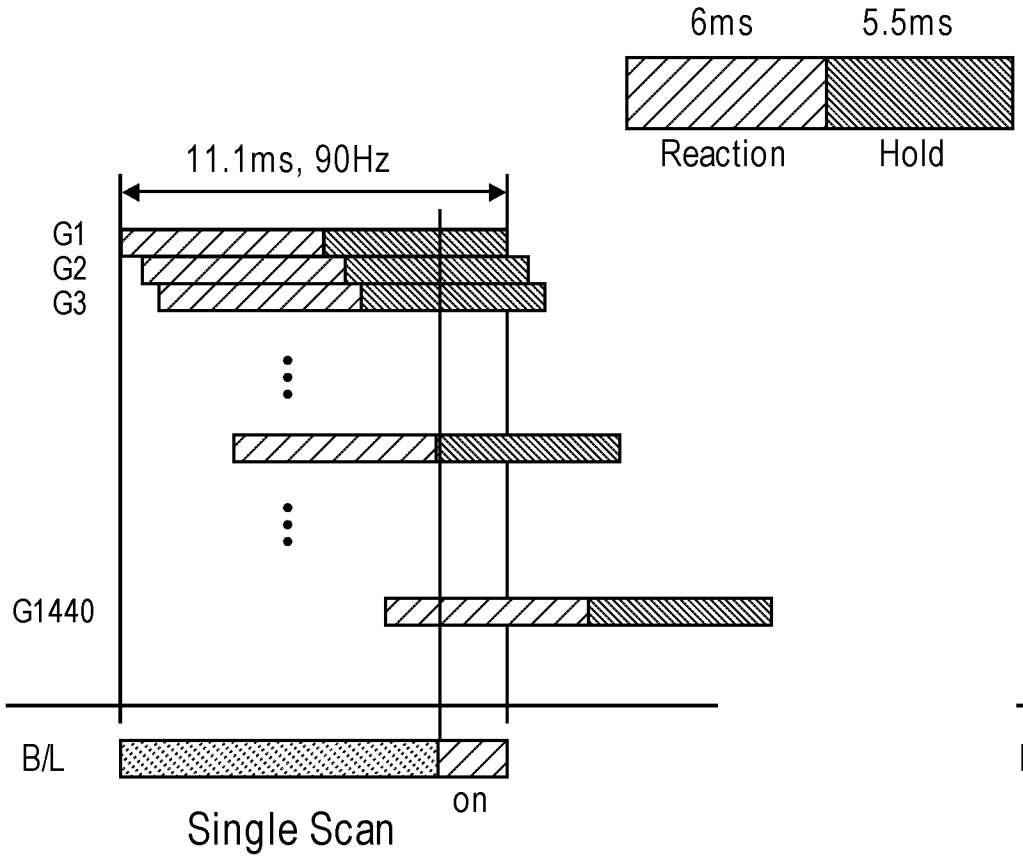
FIGS. 7A and 7B illustrate panel timing of single scan and dual scan scheme, respectively.
Figure 7B:
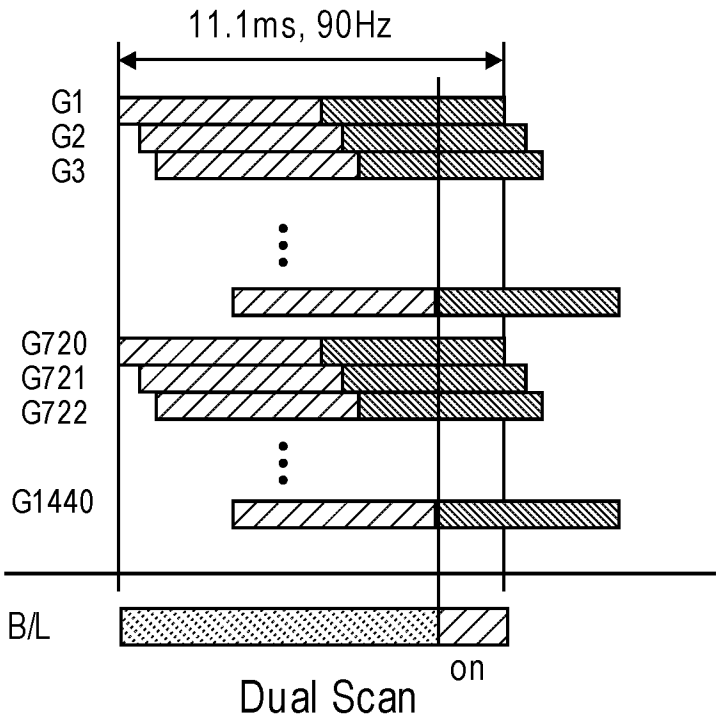

With the dual-scan implementation, if the two pipes and the two TCONs are running at higher pixel clock corresponding to the normal 60 Hz refresh but with extended Vblank timing, then it can help relax the response time requirement for LCD based panels for low persistence and low latency support. The challenge for LCD based panels to be used in a VR system is the slow response time. Today, the response time of most LCD displays is above 10 ms. For a VR application, display vendors have demoed ~6 ms response time panels with strobing or scanning backlight for low persistence mode. However, even a 6 ms response time is not fast enough using traditional driving and extended Vblank—as the timing is limited by the speed that the display driver IC (DDIC) can support. The resulting artifact is brightness non-uniformity. The fully switched areas will be brighter than the area not fully switched. Using the dual scan mode described herein with extended Vblank timing can help provide enough time for all pixels to be fully switched on with ~6 ms response time. FIGS. 7A and 7B illustrate panel timing of single scan and dual scan scheme, respectively, with strobing backlight. As shown in FIGS. 7A and 7B, dual scan scheme helps relax the response time requirement.

Figure 8:
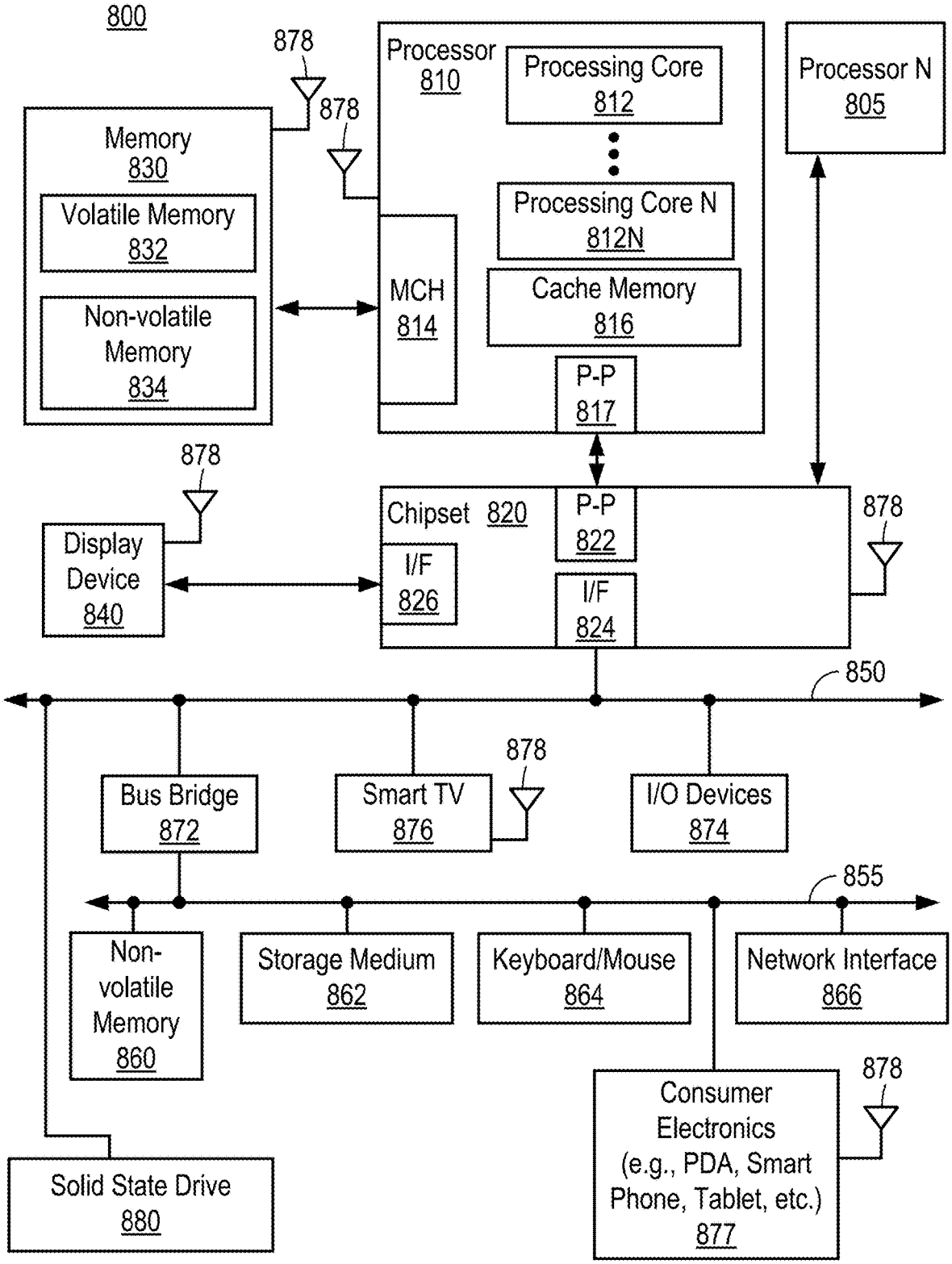
FIG. 8 is a block diagram of one embodiment of a computer system.

FIG. 8 is one embodiment of a system level diagram 800 that may incorporate the techniques described above. For example, the techniques described above may be used in conjunction with a processor in system 800 or other part of system 800.

Referring to FIG. 8, system 800 includes, but is not limited to, a desktop computer, a laptop computer, a netbook, a tablet, a notebook computer, a personal digital assistant (PDA), a server, a workstation, a cellular telephone, a mobile computing device, a smart phone, an Internet appliance or any other type of computing device. In another embodiment, system 800 implements the methods disclosed herein and may be a system on a chip (SOC) system.

In one embodiment, processor 810 has one or more processor cores 812 to 812N, where 812N represents the Nth processor core inside the processor 810 where N is a positive integer. In one embodiment, system 800 includes multiple processors including processors 810 and 805, where processor 805 has logic similar or identical to logic of processor 810. In one embodiment, system 800 includes multiple processors including processors 810 and 805 such that processor 805 has logic that is completely independent from the logic of processor 810. In such an embodiment, a multi-package system 800 is a heterogeneous multi-package system because the processors 805 and 810 have different logic units. In one embodiment, processing core 812 includes, but is not limited to, pre-fetch logic to fetch instructions, decode logic to decode the instructions, execution logic to execute instructions and the like. In one embodiment, processor 810 has a cache memory 816 to cache instructions and/or data of the system 800. In another embodiment of the invention, cache memory 816 includes level one, level two and level three, cache memory, or any other configuration of the cache memory within processor 810.

In one embodiment, processor 810 includes a memory control hub (MCH) 814, which is operable to perform functions that enable processor 810 to access and communicate with a memory 830 that includes a volatile memory 832 and/or a non-volatile memory 834. In one embodiment, memory control hub (MCH) 814 is positioned outside of processor 810 as an independent integrated circuit.

In one embodiment, processor 810 is operable to communicate with memory 830 and a chipset 820. In such an embodiment, SSD 880 executes the computer-executable instructions when SSD 880 is powered up.

In one embodiment, processor 810 is also coupled to a wireless antenna 878 to communicate with any device configured to transmit and/or receive wireless signals. In one embodiment, wireless antenna interface 878 operates in accordance with, but is not limited to, the IEEE 802.11 standard and its related family, HomePlug AV (HPAV), Ultra Wide Band (UWB), Bluetooth, WiMAX, or any form of wireless communication protocol.

In one embodiment, the volatile memory 832 includes, but is not limited to, Synchronous Dynamic Random Access Memory (SDRAM), Dynamic Random Access Memory (DRAM), RAMBUS Dynamic Random Access Memory (RDRAM), and/or any other type of random access memory device. Non-volatile memory 834 includes, but is not limited to, flash memory (e.g., NAND, NOR), phase change memory (PCM), read-only memory (ROM), electrically erasable programmable read-only memory (EEPROM), or any other type of non-volatile memory device.

Memory 830 stores information and instructions to be executed by processor 810. In one embodiment, chipset 820 connects with processor 810 via Point-to-Point (PtP or P-P) interfaces 817 and 822. In one embodiment, chip set 820 enables processor 810 to connect to other modules in the system 800. In one embodiment, interfaces 817 and 822 operate in accordance with a PtP communication protocol such as the Intel QuickPath Interconnect (QPI) or the like.

In one embodiment, chip set 820 is operable to communicate with processor 810, 805, display device 840, and other devices 872, 876, 874, 860, 862, 864, 866, 877, etc. In one embodiment, chipset 820 is also coupled to a wireless antenna 878 to communicate with any device configured to transmit and/or receive wireless signals.

In one embodiment, chip set 820 connects to a display device 840 via an interface 826. In one embodiment, display device 840 includes, but is not limited to, liquid crystal display (LCD), plasma, cathode ray tube (CRT) display, or any other form of visual display device. In addition, chipset 820 connects to one or more buses 850 and 855 that interconnect various modules 874, 860, 862, 864, and 866. In one embodiment, buses 850 and 855 may be interconnected together via a bus bridge 872 if there is a mismatch in bus speed or communication protocol. In one embodiment, chipset 820 couples with, but is not limited to, a non-volatile memory 860, a mass storage device(s) 862, a keyboard/mouse 864, and a network interface 866 via interface 824, smart TV 876, consumer electronics 877, etc.

In one embodiment, mass storage device 862 includes, but is not limited to, a solid state drive, a hard disk drive, a universal serial bus flash memory drive, or any other form of computer data storage medium. In one embodiment, network interface 866 is implemented by any type of well-known network interface standard including, but not limited to, an Ethernet interface, a universal serial bus (USB) interface, a Peripheral Component Interconnect (PCI) Express interface, a wireless interface and/or any other suitable type of interface.

While the modules shown in FIG. 8 are depicted as separate blocks within the system 800, the functions performed by some of these blocks may be integrated within a single semiconductor circuit or may be implemented using two or more separate integrated circuits.

There are a number of example embodiments described herein.

Example 1 is a computing system that comprises a display and a controller to provide data for separate portions of the display simultaneously.

Example 2 is the computing system of example 1 that may optionally include that the display comprises a plurality of sets of gate and source drivers, each set of the plurality of sets of gate and source drivers to display data on a distinct one of the portions of the display.

Example 3 is the computing system of example 2 that may optionally include that the portions comprise halves of the display and the plurality of sets of gate and source drivers comprises two sets of gate and source drivers.

Example 4 is the computing system of example 2 that may optionally include a plurality of data pipes, and wherein each set of gate and source drivers are provided data for display from a distinct data pipe of the plurality of data pipes.

Example 5 is the computing system of example 4 that may optionally include a frame buffer, where the frame buffer is divided between the plurality of data pipes.

Example 6 is the computing system of example 5 that may optionally include that separate sets of frame data for each of the plurality of data pipes is fetched from the frame buffer in parallel in an isochronous manner and sent to the plurality of data pipes that scan out the frame data in parallel to the display.

Example 7 is the computing system of example 4 that may optionally include that each of the plurality of data pipes scan out data in a time-synchronized manner.

Example 8 is the computing system of example 4 that may optionally include that each of the plurality of data pipes scan out data at a first rate equal to a refresh rate of the display panel as a whole.

Example 9 is the computing system of example 2 that may optionally include that the plurality of sets of gate and source drivers are driven by a single pipe from the controller, wherein the single pipe has a plurality of ports, with each of the plurality of ports providing data for a distinct one of the plurality of sets of gate and source drivers.

Example 10 is the computing system of example 1 that may optionally include that the display is part of a virtual reality (VR).

Example 11 is an apparatus comprising a frame buffer storing data for display, and a plurality of data pipes coupled the frame buffer, each of the plurality of data pipes operable to scan out data to a display, wherein separate sets of frame data for each of the plurality of data pipes is fetched from the frame buffer in parallel and sent to the plurality of data pipes for scanning out in parallel to the display.

Example 12 is the apparatus of example 11 that may optionally include that each of the plurality of data pipes scan out data in a time-synchronized manner.

Example 13 is the apparatus of example 11 that may optionally include that each of the plurality of data pipes scan out data at a first rate equal to a refresh rate of the display as a whole.

Example 14 is the apparatus of example 11 that may optionally include that the plurality of data pipes comprises two data pipes.

Example 15 is the apparatus of example 11 that may optionally include that the plurality of data pipes comprises two data pipes.

Example 16 is the apparatus of example 11 that may optionally include a plurality of ports, one of the plurality of ports for each data pipe of the plurality of data pipes.

Example 17 is a non-transitory machine-readable medium having stored thereon one or more instructions, which if performed by a machine causes the machine to perform a method comprising: detecting a device having a display with a plurality of sets of drivers, each set of the plurality of sets of drivers to display data on a portion of the display separate from other portions of the display that other sets of the plurality of gate and source drivers display data; configuring a display controller to use a plurality of data pipes for scanout of data to the display; dividing data in the frame buffer into a plurality of regions; fetching frame data for each of the plurality of regions from the frame buffer in parallel; and sending the frame data for each of the plurality of regions to a distinct one of the plurality of pipes for scan out in parallel to the display.

Example 18 is the non-transitory machine-readable medium of example 17 that may optionally include that the method further comprises: dividing horizontal resolution of the display by two to generate a resolution for left and right data streams; and determining timing required to drive the left and right data streams to the display using two of the plurality of data pipes.

Example 19 is the non-transitory machine-readable medium of example 17 that may optionally include that the method further comprises configuring one of the plurality of pipes as a timing master for scanout of data.

Example 20 is the non-transitory machine-readable medium of example 17 that may optionally include that the plurality of regions comprises rectangular regions next to each other.

Example 21 is the non-transitory machine-readable medium of example 17 that may optionally include that the device is a VR device.

Example 22 is the non-transitory machine-readable medium of example 17 that may optionally include that each set of the plurality of sets of drivers comprises a set of gate and source drivers.

Example 23 is the non-transitory machine-readable medium of example 17 that may optionally include that the plurality of data pipes comprises two data pipes.

Example 24 is the non-transitory machine-readable medium of example 17 that may optionally include that the plurality of data pipes comprises two data pipes.

Example 25 is the non-transitory machine-readable medium of example 17 that may optionally include that each of the plurality of data pipes includes a port through which frame data is provided to the display.

Some portions of the detailed descriptions above are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general purpose systems may be used with programs in accordance with the teachings herein, or it may prove convenient to construct more specialized apparatus to perform the required method steps. The required structure for a variety of these systems will appear from the description below. In addition, the present invention is not described with reference to any particular programming language. It will be appreciated that a variety of programming languages may be used to implement the teachings of the invention as described herein.

A machine-readable medium includes any mechanism for storing or transmitting information in a form readable by a machine (e.g., a computer). For example, a machine-readable medium includes read only memory ("ROM"); random access memory ("RAM"); magnetic disk storage media; optical storage media; flash memory devices; etc.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as essential to the invention.

We claim:

1. A computing system comprising:

a display comprising a plurality of pixels; and a controller to provide separate data for a virtual reality (VR) display on separate portions of the display simultaneously using dual scanout for a VR application, wherein the display further comprises a plurality of sets of gate and source drivers, each set of the plurality of sets of gate and source drivers to display data for the VR display on pixels corresponding to a distinct one of the portions of the display, and wherein the controller uses a dual scanout pixel clock that is at a higher rate than a pixel clock used when a single set of data is provided at one time to and is displayed on the display as a whole, and wherein the dual scanout pixel clock causes the controller to use a refresh rate corresponding to a single scanout of the display and an extended vertical blanking (Vblank) interval that allows for all pixels of the display to be fully switched when a response time of the VR display in the VR application is less than a response time of the pixels of the display.

2. The computing system of claim 1 wherein the portions comprise halves of the display and the plurality of sets of gate and source drivers comprises two sets of gate and source drivers.

3. The computing system of claim 1 further comprising a plurality of data pipes, and wherein each set of gate and source drivers are provided data for display from a distinct data pipe of the plurality of data pipes.

4. The computing system of claim 3 further comprising a frame buffer, the frame buffer being divided between the plurality of data pipes.

5. The computing system of claim 4 wherein separate sets of frame data for each of the plurality of data pipes is fetched from the frame buffer in parallel in an isochronous manner and sent to the plurality of data pipes that scan out the frame data in parallel to the display.

6. The computing system of claim 3 wherein each of the plurality of data pipes scan out data in a time-synchronized manner.

7. The computing system of claim 3 wherein each of the plurality of data pipes scan out data at a first rate equal to a refresh rate of the display panel as a whole.

8. The computing system of claim 1 wherein the plurality of sets of gate and source drivers are driven by a single pipe from the controller, wherein the single pipe has a plurality of ports, with each of the plurality of ports providing data for a distinct one of the plurality of sets of gate and source drivers.

9. An apparatus comprising:

a frame buffer to store data for a virtual reality (VR) display of a VR application;

a plurality of data pipes coupled the frame buffer, each of the plurality of data pipes operable to scan out separate data to a display comprising a plurality of pixels, wherein separate sets of frame data for each of the plurality of data pipes is to be fetched from the frame buffer in parallel and sent to the plurality of data pipes for scanning out in parallel to the display for the VR application; and a controller that uses a dual scanout pixel clock that is at a higher rate than a pixel clock used when a single set of data is provided from the frame buffer and is displayed on the display as a whole, and wherein the dual scanout pixel clock causes the controller to use a refresh rate corresponding to a single scanout of the display and an extended vertical blanking (Vblank) interval that allows for all pixels of the display to be fully switched when a response time of the VR display in the VR application is less than a response time of the pixels of the display.

10. The apparatus of claim 9 wherein each of the plurality of data pipes scan out data in a time-synchronized manner.

11. The apparatus of claim 9 wherein each of the plurality of data pipes scan out data at a first rate equal to a refresh rate of the display as a whole.

12. The apparatus of claim 9 wherein the plurality of data pipes comprises two data pipes.

13. The apparatus of claim 9 wherein the plurality of data pipes comprises four data pipes.

14. The apparatus of claim 9 further comprising a plurality of ports, one of the plurality of ports for each data pipe of the plurality of data pipes.

15. A non-transitory machine-readable medium having stored thereon one or more instructions, which if performed by a machine causes the machine to perform a method comprising:

detecting a device having a display with a plurality of sets of drivers and a plurality of pixels, each set of the plurality of sets of drivers to display data on a portion of the display separate from other portions of the display that other sets of the plurality of gate and source drivers display data;

configuring a display controller to use a plurality of data pipes for scanout of data to the display for a virtual reality (VR) application, wherein a display controller configuration comprises a dual scanout pixel clock used by the display controller that is at a higher rate than a pixel clock used when a single set of data is provided from the frame buffer and is displayed on the display as a whole, and wherein the dual scanout pixel clock configures the display controller to use a refresh rate corresponding to a single scanout of the display and an extended vertical blanking (Vblank) interval that allows for all pixels of the display to be fully switched when a response time of the VR display in the VR application is less than a response time of the pixels of the display;

dividing data in the frame buffer into a plurality of regions for a display;

fetching frame data for each of the plurality of regions from the frame buffer in parallel; and sending the frame data for each of the plurality of regions to a distinct one of the plurality of pipes for scan out in parallel to the display at the higher rate of the dual scanout pixel clock.

16. The non-transitory machine-readable medium defined in claim 15 wherein the method further comprises:

dividing horizontal resolution of the display by two to generate a resolution for left and right data streams; and determining timing required to drive the left and right data streams to the display using two of the plurality of data pipes.

17. The non-transitory machine-readable medium of claim 15 wherein the method further comprises configuring one of the plurality of pipes as a timing master for scanout of data.

18. The non-transitory machine-readable medium of claim 15 wherein the plurality of regions comprises rectangular regions next to each other.

19. The non-transitory machine-readable medium of claim 15 wherein the device is a VR device.

20. The non-transitory machine-readable medium of claim 15 wherein each set of the plurality of sets of drivers comprises a set of gate and source drivers.

21. The non-transitory machine-readable medium of claim 15 wherein the plurality of data pipes comprises two data pipes.

22. The non-transitory machine-readable medium of claim 15 wherein the plurality of data pipes comprises four data pipes.

23. The non-transitory machine-readable medium of claim 15 wherein each of the plurality of data pipes includes a port through which frame data is provided to the display.

* * * * *